US008442745B2

(12) United States Patent
Ando

(10) Patent No.: US 8,442,745 B2
(45) Date of Patent: May 14, 2013

(54) FUEL SUPPLY APPARATUS FOR INTERNAL COMBUSTION ENGINE AND CONTROL METHOD THEREOF

(75) Inventor: Daigo Ando, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 41 days.

(21) Appl. No.: 13/228,191

(22) Filed: Sep. 8, 2011

(65) Prior Publication Data

US 2012/0065868 A1 Mar. 15, 2012

(30) Foreign Application Priority Data

Sep. 9, 2010 (JP) ..... 2010-202288

(51) Int. Cl.
*F02M 37/06* (2006.01)

(52) U.S. Cl.
USPC ..... 701/107; 701/112; 123/506; 123/508; 123/511; 123/514; 123/479; 123/690

(58) Field of Classification Search ..... 701/103, 701/107, 112; 123/506–508, 511, 514, 479, 123/690
See application file for complete search history.

(56) References Cited

U.S. PATENT DOCUMENTS

| | | | | |
|---|---|---|---|---|
| 5,715,786 | A * | 2/1998 | Seiberth | 123/198 D |
| 5,918,578 | A * | 7/1999 | Oda | 123/456 |
| 7,520,266 | B2 * | 4/2009 | Barnes et al. | 123/446 |
| 7,634,986 | B2 * | 12/2009 | Kuroda et al. | 123/457 |
| 7,966,984 | B2 * | 6/2011 | Ulrey et al. | 123/179.17 |

FOREIGN PATENT DOCUMENTS

| | | |
|---|---|---|
| JP | 10-176592 A | 6/1998 |
| JP | 2007-100624 A | 4/2007 |

* cited by examiner

*Primary Examiner* — Erick Solis
(74) *Attorney, Agent, or Firm* — Gifford, Krass, Sprinkle, Anderson & Citkowski, P.C.

(57) ABSTRACT

In control executed by a fuel supply apparatus having a delivery passage that delivers fuel to a fuel injection valve, a fuel pump that pumps the fuel from a fuel tank to the delivery passage, and a check valve that allows the fuel to flow out of the delivery passage into the fuel tank, that opens when a first fuel pressure on the delivery passage is higher than a second fuel pressure on the fuel tank by at least a set pressure, when the first fuel pressure is lower than a lower limit pressure being higher than the set pressure in a case where fuel injection is to be stopped, the fuel pump is controlled so that the first fuel pressure rises to or above the lower limit pressure, and after the first fuel pressure has reached or exceeded the lower limit pressure, the abnormality diagnosis is executed on the check valve.

7 Claims, 8 Drawing Sheets

FUEL SUPPLY APPARATUS FOR INTERNAL COMBUSTION ENGINE AND CONTROL METHOD THEREOF

INCORPORATION BY REFERENCE

This applications claims priority to Japanese Patent Application No. 2010-202288, filed on Sep. 9, 2010, which is incorporated herein by reference in its entirety including the specification, drawings and abstract.

BACKGROUND OF THE INVENTION

1. Field of the Invention

The invention relates to a fuel supply apparatus for an internal combustion engine and a control method thereof, and more particularly relates to a fuel supply apparatus for an internal combustion engine including a fuel injection valve that injects fuel into the internal combustion engine, a delivery passage that delivers the fuel to the fuel injection valve, a fuel tank that stores the fuel, and a fuel pump that is driven by rotation of the internal combustion engine to regulate the fuel from the tank to a desired pressure and pump the fuel to the delivery passage, and to a control method thereof.

2. Description of Related Art

An apparatus including a fuel injection valve that injects fuel into an internal combustion engine, a common rail that holds the fuel to be supplied to the fuel injection valve in a high pressure condition, a fuel tank that stores the fuel, a fuel pump that pressurizes the fuel from the fuel tank using power from an output shaft of the internal combustion engine and supplies the pressurized fuel to the common rail, a pressure reducing valve that is opened and closed through electrification to allow the fuel in the common rail to flow out into the fuel tank via a low pressure fuel passage, and a fuel pressure sensor that detects a fuel pressure in the common rail, wherein the presence of an abnormality in the pressure reducing valve is diagnosed on the basis of a reduction in the fuel pressure in the common rail, detected by the fuel pressure sensor, when an ignition switch is switched OFF such that an opening operation is performed on the pressure reducing valve, has been proposed as this type of fuel supply apparatus for an internal combustion engine (see Japanese Patent Application Publication No. 2007-100624 (JP-A-2007-100624), for example). In this apparatus, the pressure reducing valve is determined to be normal when a reduction speed of the detected fuel pressure is no lower than a threshold at which the pressure reducing valve is assumed to be normal and determined to be abnormal when the reduction speed is lower than the threshold.

In the fuel supply apparatus for an internal combustion engine described above, however, it may be impossible to determine the presence of an abnormality in the pressure reducing valve properly when the fuel pressure in the common rail is low immediately before fuel injection through the fuel injection valve is stopped. For example, in a vehicle installed with an internal combustion engine as a power source, the ignition switch may be switched OFF such that an opening operation is performed on the pressure reducing valve while the internal combustion engine is operating at a low load or no load, and in this case, the fuel pressure in the common rail immediately before the opening operation on the pressure reducing valve is in a reduced state required for the internal combustion engine to operate at a low load or no load. Hence, even when the pressure reducing valve is opened in this state, it may be impossible to obtain a fuel pressure reduction speed required for the diagnosis, and as a result, it may be impossible to diagnose the pressure reducing valve properly. Further, when a pressure reducing valve that requires electrification for opening/closing control is used, an abnormality outside of a pressure reducing valve main body, such as an abnormality in a drive circuit for driving the pressure reducing valve, may occur, and it is therefore desirable to be able to reduce the fuel pressure in the common rail using a simpler structure.

SUMMARY OF THE INVENTION

The invention provides a fuel supply apparatus for an internal combustion engine and a control method thereof with which a fuel pressure in a delivery passage that delivers fuel to a fuel injection valve can be reduced with a simpler structure and an abnormality diagnosis can be executed on a check valve more reliably.

A fuel supply apparatus for an internal combustion engine according to a first aspect of the invention includes a fuel injection valve that performs fuel injection into the internal combustion engine, a delivery passage that delivers fuel to the fuel injection valve, a fuel tank that stores the fuel, and a fuel pump that regulates the fuel from the fuel tank to a desired pressure and pumps the fuel to the delivery passage. The fuel supply apparatus also includes: a check valve that is disposed in a position that allows the fuel to flow out of the delivery passage into the fuel tank, that opens when a fuel pressure on the delivery passage side with respect to the check valve is higher than a fuel pressure on the fuel tank side with respect to the check valve by at least a set pressure set at a fuel pressure permitted to act on the fuel injection valve when the fuel injection by the fuel injection valve is stopped, and that while open allows the fuel to flow in an amount that enables the fuel pumped into the delivery passage by the fuel pump to be regulated to the desired pressure; a fuel pressure sensor that is attached to the delivery passage to detect the fuel pressure in the delivery passage; and a control unit that, when the fuel pressure detected by the fuel pressure sensor is lower than a diagnosis lower limit pressure being higher than the set pressure in a case where the fuel injection by the fuel injection valve is to be stopped in a state where an execution condition for an abnormality diagnosis on the check valve, in which the presence of an abnormality in the check valve is diagnosed by confirming a reduction in the fuel pressure detected by the fuel pressure sensor, is established, controls the fuel pump so that the fuel pressure in the delivery passage rises to or above the diagnosis lower limit pressure, and executes the abnormality diagnosis on the check valve after the fuel pressure detected by the fuel pressure sensor has reached or exceeded the diagnosis lower limit pressure.

The fuel supply apparatus described above includes the check valve that is disposed in a position that allows the fuel to flow out of the delivery passage into the fuel tank, that opens when the fuel pressure on the delivery passage side thereof is higher than the fuel pressure on the fuel tank side thereof by at least the set pressure set at the fuel pressure permitted to act on the fuel injection valve when the fuel injection by the fuel injection valve is stopped, and that while open allows the fuel to flow in an amount that enables the fuel pumped into the delivery passage by the fuel pump to be regulated to the desired pressure during regulation of the fuel to the desired pressure, and the fuel pressure sensor that detects the fuel pressure in the delivery passage. Therefore, the fuel pressure in the delivery passage that delivers the fuel to the fuel injection valve can be reduced using a simpler structure. Further, when the fuel pressure detected by the fuel pressure sensor is lower than the diagnosis lower limit pressure set at a higher pressure than the set pressure in a case where the fuel injection by the fuel injection valve is to be stopped in a state where the execution condition for the abnormality diagnosis on the check valve, in which the presence of an abnormality in the check valve is diagnosed by confirming a reduction in the fuel pressure detected by the fuel pressure sensor, is established, the fuel pump is controlled so that the fuel pressure in the delivery passage rises to or above the diagnosis lower limit pressure, and the abnormality diagnosis is executed on the check valve after the fuel pressure detected by the fuel pressure sensor has reached or exceeded the diagnosis lower limit pressure. As a result, the abnormality diagnosis can be executed more reliably on the check valve that allows the fuel pressure in the delivery passage to decrease. Here, the "position that allows the fuel to flow out of the delivery passage into the fuel tank" includes a position that allows the fuel to flow out of the delivery passage into the fuel tank without passing through the fuel pump, a position that allows the fuel to flow out of the delivery passage into the fuel tank via the fuel pump, and so on.

In the fuel supply apparatus described above, when an idle operation is required in the internal combustion engine, even though the fuel injection by the fuel injection valve is to be stopped in response to a request in a state where the execution condition for the abnormality diagnosis on the check valve is established, the control unit may control the fuel pump and the fuel injection valve such that the fuel pressure in the delivery passage reaches or exceeds the diagnosis lower limit pressure and the fuel injection by the fuel injection valve is continued in order to perform the idle operation in the internal combustion engine, and when a predetermined termination condition for terminating the idle operation in the internal combustion engine is established and the fuel pressure detected by the fuel pressure sensor has reached or exceeded the diagnosis lower limit pressure, the control unit may control the fuel injection valve such that the fuel injection by the fuel injection valve is stopped, and execute the abnormality diagnosis on the check valve. In so doing, the period of the idle operation in the internal combustion engine can be used to set the fuel pressure in the delivery passage at or above the diagnosis lower limit pressure, and as a result, the abnormality diagnosis can be executed on the check valve more reliably. In the fuel supply apparatus described above, the predetermined termination condition may be established when an opening/closing timing of an intake valve in the internal combustion engine reaches a predetermined stop timing. The "predetermined stop timing" may be a maximally retarded timing within a modifiable range.

In the fuel supply apparatus described above, the fuel pump may include a compression chamber connected to the delivery passage and a supply passage to which fuel regulated to a predetermined low pressure is supplied from the fuel tank, an intake valve disposed in a fuel intake port between the supply passage and the compression chamber, and a pump check valve that is interposed between a discharge port for discharging the fuel from the compression chamber and the delivery passage, and opens when a fuel pressure on the discharge port side with respect to the check valve is higher than a fuel pressure on the delivery passage side with respect to the check valve by at least a second set pressure set at a lower pressure than the predetermined low pressure. When driven by a rotation of the internal combustion engine, the fuel pump may pump the fuel regulated to the desired pressure into the delivery passage by adjusting an opening/closing timing of the intake valve, and when not driven by the rotation of the internal combustion engine, the intake valve may be opened to communicate the supply passage with the discharge port. The check valve may be disposed in a bypass passage that is connected to the delivery passage and to the discharge port or the fuel tank side with respect to the discharge port so as to bypass the pump check valve, the bypass passage serving as the aforesaid position. The control unit may use a higher pressure than a total pressure of the predetermined low pressure and the set pressure as the diagnosis lower limit pressure to control the opening/closing timing of the intake valve of the fuel pump when controlling the fuel pressure in the delivery passage to or above the diagnosis lower limit pressure. In the fuel supply apparatus described above, the diagnosis lower limit pressure may be set at a total pressure of the predetermined low pressure, the set pressure, and a predetermined determination confirmation pressure that is set at a pressure required to determine that the check valve is operating normally. In so doing, the abnormality diagnosis can be executed on the check valve even more reliably.

In the fuel supply apparatus described above, the fuel supply apparatus is installed in a vehicle, and if the vehicle is not in motion even when the fuel pressure detected by the fuel pressure sensor is lower than the diagnosis lower limit pressure in a case where the fuel injection by the fuel injection valve is to be stopped in the state where the execution condition for the abnormality diagnosis on the check valve is established, the control unit may execute the abnormality diagnosis on the check valve without driving the fuel pump. Hence, even if the fuel pressure detected by the fuel pressure sensor is lower than the diagnosis lower limit pressure, the fuel pump is not driven unless the vehicle is in motion, or in other words, the fuel pump is driven only when the vehicle is in motion. Therefore, driving of the fuel pump in a state where background noise is not being generated by the motion of the vehicle can be suppressed, and as a result, a situation in which a driver or a passenger experiences a sense of discomfort caused by noise generated when the fuel pump is driven can be suppressed.

A fuel supply apparatus for an internal combustion engine according to a second aspect of the invention relates to a control method of a fuel supply apparatus for an internal combustion engine, the fuel supply apparatus having a fuel injection valve that performs fuel injection into the internal combustion engine, a delivery passage that delivers fuel to the fuel injection valve, a fuel tank that stores the fuel, a fuel pump that regulates the fuel from the fuel tank to a desired pressure and pumps the fuel to the delivery passage, a check valve that is disposed in a position that allows the fuel to flow out of the delivery passage into the fuel tank, that opens when a fuel pressure on the delivery passage side with respect to the check valve is higher than a fuel pressure on the fuel tank side with respect to the check valve by at least a set pressure set at a fuel pressure permitted to act on the fuel injection valve when the fuel injection by the fuel injection valve is stopped, and that while open allows the fuel to flow in an amount that enables the fuel pumped into the delivery passage by the fuel pump to be regulated to the desired pressure, and a fuel pressure sensor that is attached to the delivery passage to detect the fuel pressure in the delivery passage. This control method includes controlling the fuel pump so that the fuel pressure in the delivery passage rises to or above a diagnosis lower limit pressure being higher than the set pressure when the fuel pressure detected by the fuel pressure sensor is lower than the diagnosis lower limit pressure in a case where the fuel injection by the fuel injection valve is to be stopped in a state where an execution condition for an abnormality diagnosis on the check valve, in which the presence of an abnormality in the check valve is diagnosed by confirming a reduction in the fuel pressure detected by the fuel pressure sensor, is established, and executing the abnormality diagnosis on the check valve after the fuel pressure detected by the fuel pressure sensor has reached or exceeded the diagnosis lower limit pressure.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Next, an embodiment of the invention will be described.

Figure 1:
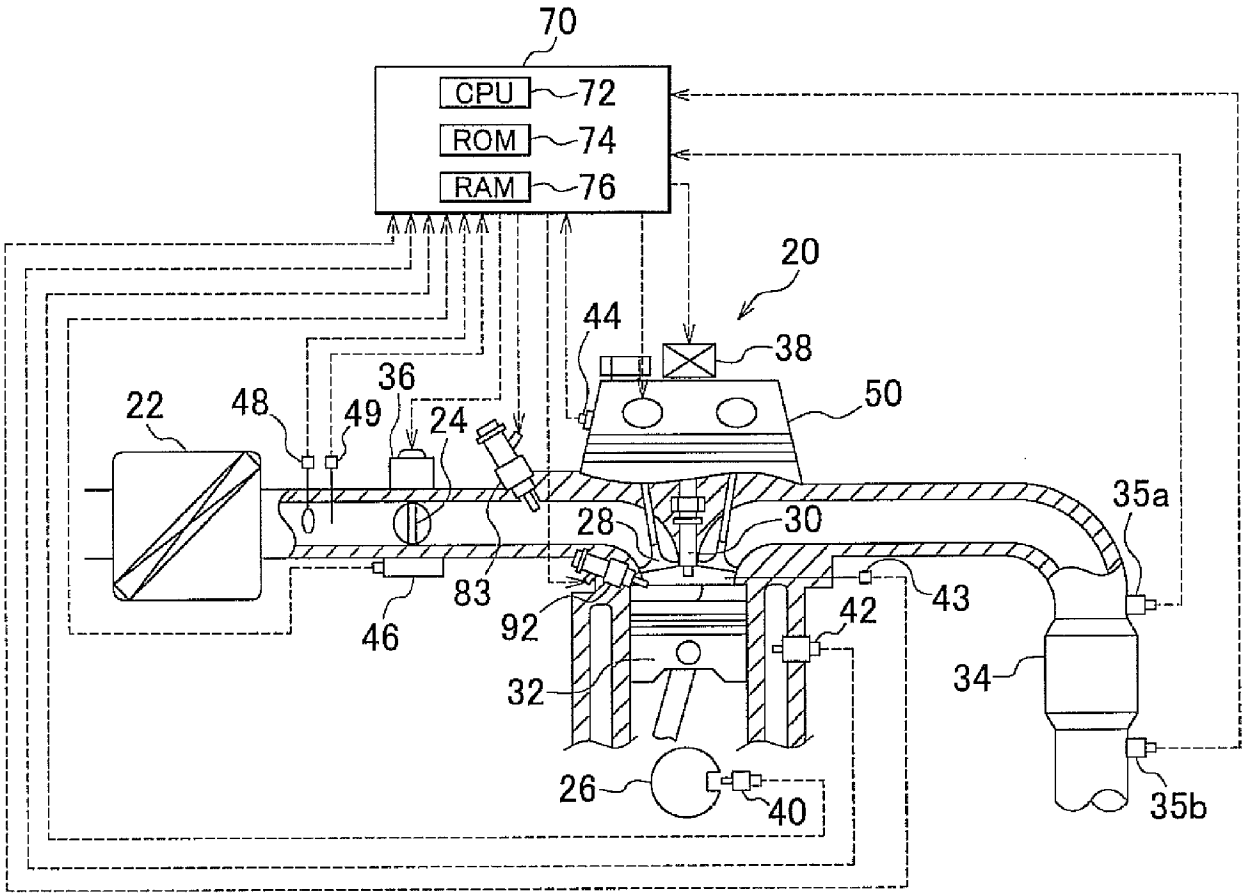
FIG. 1 is a schematic diagram showing the structure of an engine that receives a supply of fuel from a fuel supply apparatus serving as an embodiment of the invention.

FIG. 1 is a schematic diagram showing the structure of an engine 20 that receives a supply of fuel from a fuel supply apparatus 80 serving as an embodiment of the invention. The engine 20 is a multi-cylinder engine such as a four-cylinder or six-cylinder engine, for example, and as shown in the drawing, is configured as an internal combustion engine that performs fuel injection using a port fuel injection valve 83 that injects a hydrocarbon-based fuel such as gasoline or light oil into an intake port and an in-cylinder fuel injection valve 92 that injects the fuel directly into a cylinder. Using these two types of fuel injection valves, operations of the engine 20 are controlled in a plurality of driving modes, namely: a port injection driving mode in which air cleaned by an air cleaner 22 is taken in through a throttle valve 24, fuel is injected through the port fuel injection valve 83 and mixed with the taken-in air to form an air-fuel mixture that is taken into a combustion chamber via an intake valve 28 and then exploded and burned by an electric spark from a spark plug 30, whereupon a reciprocating motion of a piston 32 pushed down by resulting energy is converted into a rotary motion of a crankshaft 26; an in-cylinder injection driving mode in which air is taken into the combustion chamber similarly, fuel is injected through the in-cylinder fuel injection valve 92 during an intake stroke or after arriving at a compression stroke, and the resulting air-fuel mixture is exploded and burned by an electric spark from the spark plug 30 to obtain a rotary motion in the crankshaft 26; and a combined injection driving mode in which a rotary motion is obtained in the crankshaft 26 by injecting fuel through the port fuel injection valve 83 as air is taken into the combustion chamber and injecting fuel through the in-cylinder fuel injection valve 92 during the intake stroke or the compression stroke. These driving modes are switched on the basis of operating conditions of the engine 20, operating conditions required of the engine 20, and so on. In this embodiment, it is assumed that operation control is performed in the combined injection driving mode during a no load operation (an idle operation) and a low load operation of the engine 20 and in the in-cylinder injection driving mode during a high load operation of the engine 20. Note that exhaust gas from the engine 20 is discharged into outside air via a purification device (a three-way catalyst) 34 that purifies carbon monoxide (CO), hydrocarbon (HC), and nitrogen oxide (NOx), which are harmful components. It is assumed in this embodiment that the engine 20 is installed in a vehicle such as a hybrid automobile capable of traveling using power from the engine 20 and power from a motor, not shown in the drawings, or an automobile that travels using power from the engine 20 alone.

Figure 2:
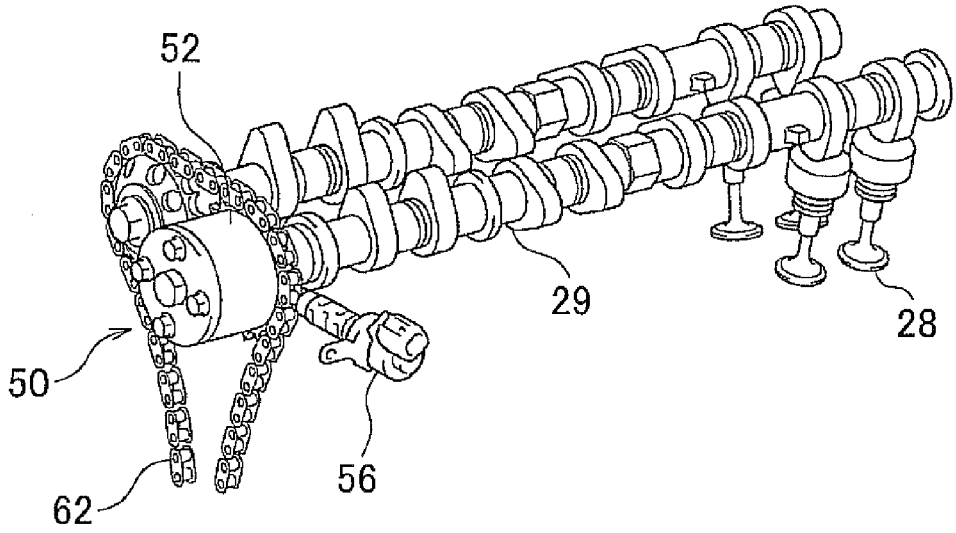
FIG. 2 is an external diagram showing the external structure of a variable valve timing mechanism.
Figure 3:
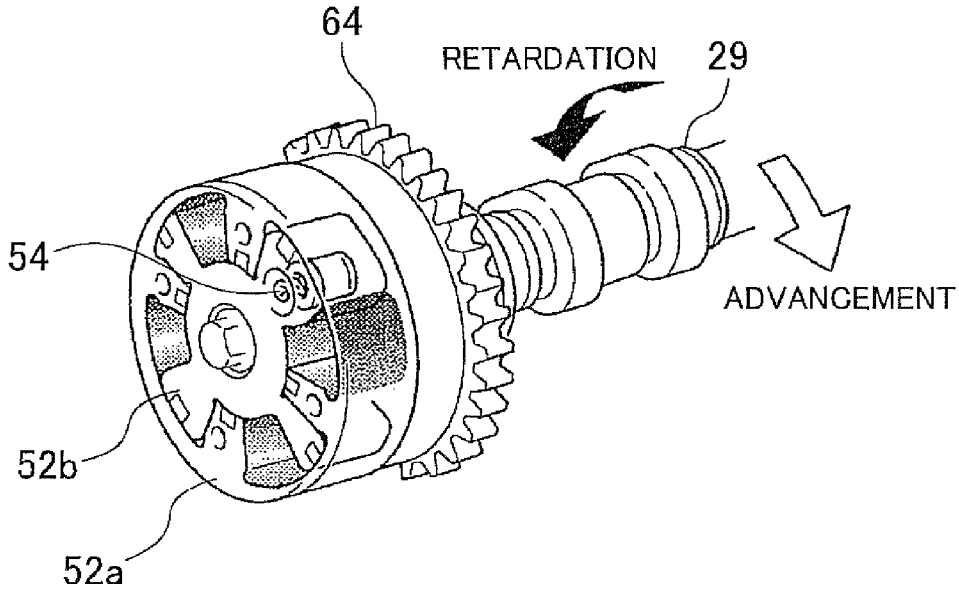
FIG. 3 is a schematic diagram showing the structure of the variable valve timing mechanism.

The engine 20 also includes a variable valve timing mechanism 50 capable of modifying an opening/closing timing VT of the intake valve 28 continuously. FIGS. 2 and 3 are schematic diagrams showing the structure of the variable valve timing mechanism 50. As shown in the drawings, the variable valve timing mechanism 50 includes a vane type VVT controller 52 formed from a housing portion 52*a* fixed to a timing gear 64 that is connected to the crankshaft 26 via a timing chain 62, and a vane portion 52*b* fixed to an intake camshaft 29 that opens and closes the intake valve 28, and an oil control valve 56 that applies oil pressure to an advancement chamber and a retardation chamber of the VVT controller 52. The vane portion 52*b* is caused to rotate relative to the housing portion 52*a* by adjusting the oil pressure applied to the advancement chamber and retardation chamber of the VVT controller 52 via the oil control valve 56, and as a result, a rotary angle of the intake camshaft 29 at the opening/closing timing VT of the intake valve 28 is modified continuously. In this embodiment, an angle of the intake camshaft 29 at an opening/closing timing VT of the intake valve 28 at which power is output efficiently from the engine 20 is set as a reference angle. By advancing the angle of the intake camshaft 29 from the reference angle, an operating condition in which high torque is output from the engine 20 can be established, and by maximally retarding the angle of the intake camshaft 29, pressure variation in the cylinders of the engine 20 can be reduced, thereby stopping the engine 20 or establishing an operating condition suitable for startup. Note that making the opening/closing timing VT of the intake valve 28 earlier, or in other words advancing the angle of the intake camshaft 29, will be referred to as "advancement", and making the opening/closing timing VT of the intake valve 28 later, or in other words retarding the angle of the intake camshaft 29, will be referred to as "retardation". Also note that a lock pin 54 for locking the relative rotation between the housing portion 52*a* and the vane portion 52*b* of the VVT controller 52 is attached to the vane portion 52*b*, and when the angle of the intake camshaft 29 is positioned at a maximally retarded angle, the lock pin 54 engages with a groove formed in the housing portion 52*a*, thereby fixing the vane portion 52*b* to the housing portion 52*a*.

Figure 4:
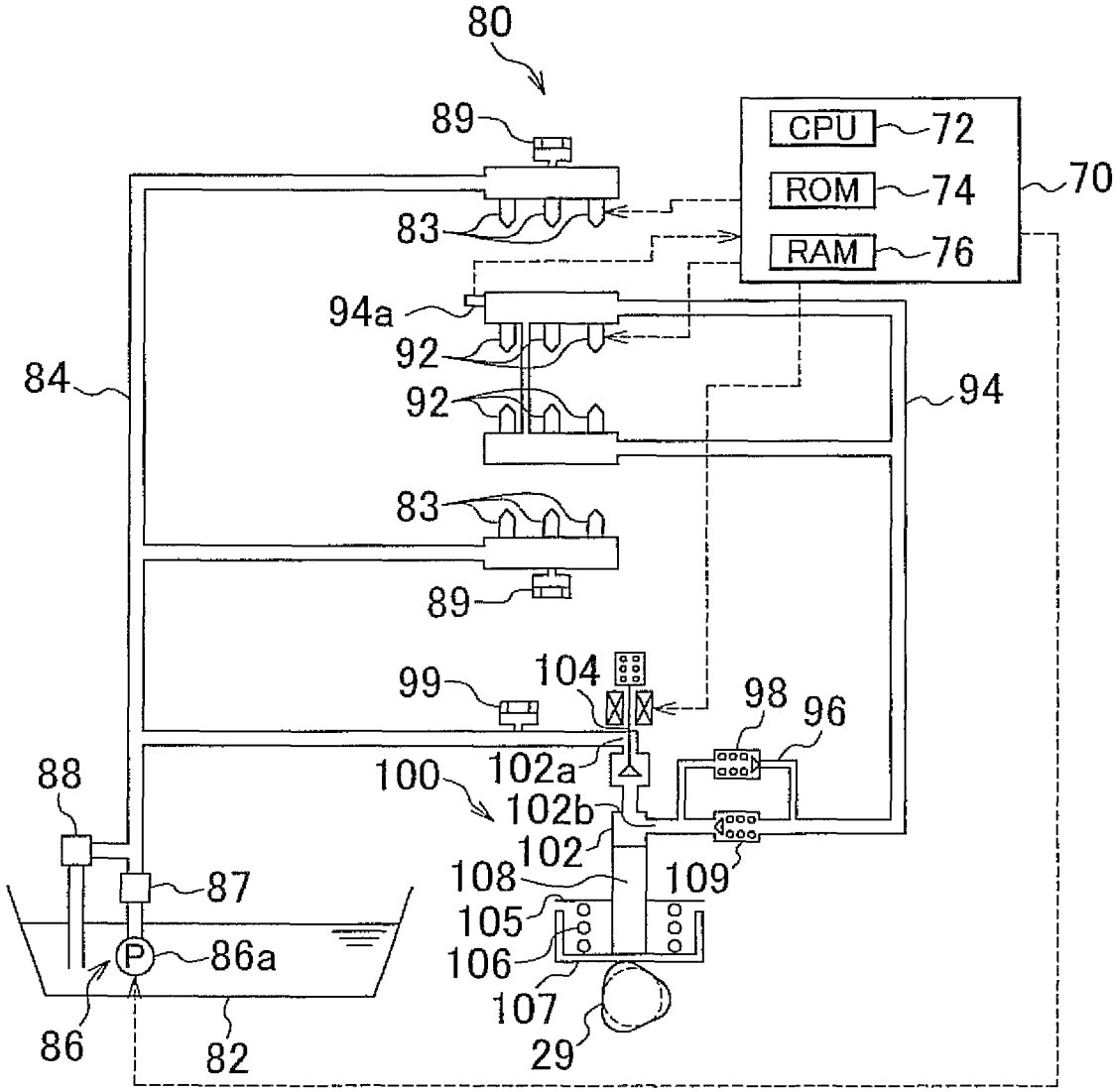
FIG. 4 is a schematic diagram showing the structure of the fuel supply apparatus of the engine.

FIG. 4 is a schematic diagram showing the structure of the fuel supply apparatus 80 of the engine 20. As shown in the drawing, the fuel supply apparatus 80 includes a fuel tank 82, the port fuel injection valve 83 provided for each cylinder, a low pressure fuel pipe 84 that delivers fuel to the port fuel injection valve 83, a low pressure fuel pump 86 that draws the fuel stored in the fuel tank 82 and pumps the drawn fuel to the low pressure fuel pipe 84, a pulsation damper 89 that is attached to the low pressure fuel pipe 84 in the vicinity of the port fuel injection valve 83 to suppress variation in a fuel pressure, the in-cylinder fuel injection valve 92 provided for each cylinder, a high pressure fuel pipe 94 that delivers fuel to the in-cylinder fuel injection valve 92, a high pressure fuel pump 100 that pressurizes the fuel in the low pressure fuel pipe 84 and pumps the pressurized fuel to the high pressure fuel pipe 94, and a pulsation damper 99 that is attached to the low pressure fuel pipe 84 in the vicinity of the high pressure fuel pump 100 to suppress variation in the fuel pressure. The low pressure fuel pump 86 includes a pump main body 86*a*, a fuel filter 87 attached to a discharge port of the pump main body 86*a* to remove foreign matter, and a pressure regulator 88 that returns fuel to the fuel tank 82 from the low pressure fuel pipe 84 when the fuel pressure in the low pressure fuel pipe 84 exceeds a preset predetermined low pressure Plow (several hundred kPa or the like, for example). From ignition ON to ignition OFF in the vehicle, the low pressure fuel pump 86 is driven normally by power supplied from an auxiliary battery, not shown in the drawing, to be capable of maintaining the fuel pressure in the low pressure fuel pipe 84 at the predetermined low pressure Plow. The high pressure fuel pump 100 includes a compression chamber 102 connected to the low pressure fuel pipe 84 and the high pressure fuel pipe 94, an intake valve 104 attached to an intake port 102*a* for taking fuel into the compression chamber 102 from the low pressure fuel pipe 84 and formed as a normally open solenoid valve that is normally open and closed by a drive signal, a movable portion 107 that is biased in a cam direction of the intake camshaft 29 by a spring 106 fixed to a support portion 105 and moved vertically when the intake camshaft 29 rotates, a plunger 108 that is attached at one end to the movable portion 107 and reciprocates within the compression chamber 102 upon reception of the vertical motion of the movable portion 107, and a pump check valve 109 attached between a discharge port 102*b* for discharging fuel from the compression chamber 102 and the high pressure fuel pipe 94. When driven mechanically by rotation of the crankshaft 26 of the engine 20, or in other words by the rotation of the intake camshaft 29, the high pressure fuel pump 100 is capable of pumping fuel that has been regulated to a desired high pressure by adjusting an opening/closing timing of the intake valve 104 to the high pressure fuel pipe 94. When the high pressure fuel pump 100 is not driven by the rotation of the engine 20, on the other hand, the intake valve 104 is open such that the low pressure fuel pipe 84 communicates with the discharge port 102*b*. In this embodiment, a range of no less than a fuel pressure Pfmin (2.5 MPa, 3 MPa, 4 MPa, or the like, for example) required for the engine 20 to perform an idle operation and no more than a fuel pressure Pfmax (between ten and twenty MPa, 20 MPa, or the like, for example) required for the engine 20 to perform a high load operation is used as a range of the desired high pressure. The pump check valve 109 opens to allow a flow of fuel when the fuel pressure on the side of the discharge port 102*b* for discharging fuel from the compression chamber 102 is higher than the fuel pressure on the high pressure fuel pipe 94 side by at least a set pressure Pset1 (several tens of kPa or the like, for example) set in advance at a lower value than the predetermined low pressure Plow, and closes to block the flow of fuel when a differential pressure obtained by subtracting the fuel pressure on the high pressure fuel pipe 94 side from the fuel pressure on the discharge port 102*b* side is lower than the set pressure Pset1.

The fuel supply apparatus 80 further includes a leakage check valve 98 attached to a bypass pipe 96 that is connected to the high pressure fuel pipe 94 and the discharge port 102*b* for discharging fuel from the compression chamber 102 of the high pressure fuel pump 100 so as to bypass the pump check valve 109, i.e. in a position that allows the fuel to flow from the high pressure fuel pipe 94 into the fuel tank 82 via the high pressure fuel pump 100. The leakage check valve 98 opens to allow a flow of fuel when the fuel pressure on the high pressure fuel pipe 94 side is higher than the fuel pressure on the side of the discharge port 102*b* for discharging fuel from the compression chamber 102 of the high pressure fuel pump 100 by at least a preset set pressure Pset2, and closes to block the flow of fuel when a differential pressure obtained by subtracting the fuel pressure on the discharge port 102*b* side from the fuel pressure on the high pressure fuel pipe 94 side is lower than the set pressure Pset2. The set pressure Pset2 of the leakage check valve 98 is a pressure determined in advance through experiment and the like at a fuel pressure that is permitted to act on the in-cylinder fuel injection valve 92 when fuel injection from the in-cylinder fuel injection valve 92 is stopped so that fuel leakage (oil tightness leakage) into the cylinder from the in-cylinder fuel injection valve 92 is suppressed within an allowable range when the engine 20 is inoperative or the like, for example. In this embodiment, a pressure (2 MPa, 3 MPa, or the like, for example) obtained by subtracting the predetermined low pressure Plow of the fuel in the low pressure fuel pipe 84 from the fuel pressure Pfmin in the high pressure fuel pipe 94 for an idle operation in the engine 20 is used as the set pressure Pset2. Further, a size (an aperture) of the leakage check valve 98 is set in advance through experiment and the like together with the size of the bypass pipe 96 so that when the leakage check valve 98 is open, only an amount of fuel that does not obstruct pressure regulation of the fuel pumped into the high pressure fuel pipe 94 by the high pressure fuel pump 100 to the desired high pressure (an amount at which the fuel pumped into the high pressure fuel pipe 94 by the high pressure fuel pump 100 can be regulated to the desired pressure) is allowed to flow.

The engine 20 is controlled by an electronic control unit for an engine (hereinafter referred to as an engine ECU 70). The engine ECU 70 is configured as a microprocessor centering on a central processing unit (CPU) 72, and includes, in addition to the CPU 72, a read-only memory (ROM) 74 that stores a processing program, a random access memory (RAM) 76 that stores data temporarily, and an input/output port and a communication port, not shown in the drawings. Signals from various sensors for detecting the conditions of the engine 20, for example a crank angle θcr from a crank position sensor 40 that detects a rotation position of the crankshaft 26, a cooling water temperature Tw from a water temperature sensor 42 that detects a temperature of cooling water in the engine 20, an in-cylinder pressure from a pressure sensor 43 mounted in the combustion chamber, cam angles from a cam position sensor 44. that detects rotation positions of the intake camshaft 29 of the intake valve 28 and an exhaust camshaft that opens and closes an exhaust valve, air being taken into and discharged from the combustion chamber by the intake valve 28 and the exhaust valve, a throttle opening Ta from a throttle valve position sensor 46 that detects a position of the throttle valve 24, an intake air amount Qa from an air flow meter 48 that is attached to an intake pipe to detect a mass flow rate of the intake air, an intake air temperature from a temperature sensor 49 likewise attached to the intake pipe, a catalyst bed temperature from a temperature sensor that detects a temperature of the purification device (the three-way catalyst) 34, an air-fuel ratio from an air-fuel ratio sensor 35*a*, an oxygen signal from an oxygen sensor 35*b*, a fuel pressure Pf from a fuel pressure sensor 94*a* that is attached to the high pressure fuel pipe 94 of the fuel supply apparatus 80 to detect the pressure of the fuel, and so on, are input into the engine ECU 70 via the input port. Further, various control signals for driving the engine 20, for example a driving signal issued to the port fuel injection valve 83, a driving signal issued to the in-cylinder fuel injection valve 92, a driving signal issued to a throttle motor 36 to adjust the position of the throttle valve 24, a control signal issued to an ignition coil 38 formed integrally with an igniter, a control signal issued to the variable valve timing mechanism 50 capable of modifying the opening/closing timing VT of the intake valve 28, a driving signal issued to the low pressure fuel pump 86, a driving signal issued to the intake valve 104 of the high pressure fuel pump 100, and so on, are output from the engine ECU 70 via the output port. Note that the engine ECU 70 communicates with a vehicle electronic control unit (ECU), not shown in the drawings, that controls the entire vehicle, and in response to control signals from the vehicle ECU, the engine ECU 70 controls operations of the engine 20 and outputs data relating to the operating conditions of the engine 20 as required. The engine ECU 70 calculates a rotation speed of the crankshaft 26, or in other words a rotation speed Ne of the engine 20, on the basis of the crank angle θcr from the crank position sensor 40.

The engine 20 according to this embodiment is operated by having the engine ECU 70 perform various types of control, such as intake air amount control, fuel injection control, and ignition control, upon reception of a target rotation speed and a target torque at which the engine 20 is to be operated, input from the vehicle ECU, and various signals indicating the conditions of the engine 20, input from the various sensors. The intake air amount control is performed by setting a target opening on the basis of the target torque and the rotation speed Ne of the engine 20 such that an amount of air required to output the target torque from the engine 20 is taken into the engine 20 through the throttle valve 24, driving the throttle motor 36 so that the throttle opening Ta of the engine 20 matches the target opening, and so on. The fuel injection control is performed by setting a target injection amount on the basis of the rotation speed Ne of the engine 20 and the intake air amount Qa so that an air-fuel ratio of the engine 20 matches a stoichiometric air-fuel ratio, for example, driving the port fuel injection valve 83 and the in-cylinder fuel injection valve 92 so that fuel injection is performed in accordance with a set target fuel injection amount Qf*, and so on. The ignition control is performed by setting a target ignition timing on the basis of the rotation speed Ne of the engine 20 and the intake air amount Qa so that a combustion efficiency of the engine 20 improves, driving the ignition coil 38 so that ignition is performed at the set target ignition timing, and so on. Further, when fuel injection is performed by the in-cylinder fuel injection valve 92, a target fuel pressure of the fuel pumped into the high pressure fuel pipe 94 by the high pressure fuel pump 100 is set on the basis of the rotation speed Ne and whether or not an idle operation is required in the engine 20, the intake valve 104 of the high pressure fuel pump 100 is driven by generating a driving signal through feedback control so that the fuel pressure Pf from the fuel pressure sensor 94*a* matches the set target fuel pressure, and so on. In the high pressure fuel pump 100 according to this embodiment, fuel at the desired high pressure is pumped into the high pressure fuel pipe 94 at a desired flow rate by keeping the intake valve 104 open when fuel is taken into the compression chamber 102 during an outward motion of the plunger 108 and adjusting a timing at which the intake valve 104 is closed in accordance with the target fuel pressure during a return motion of the plunger 108.

Figure 5A:
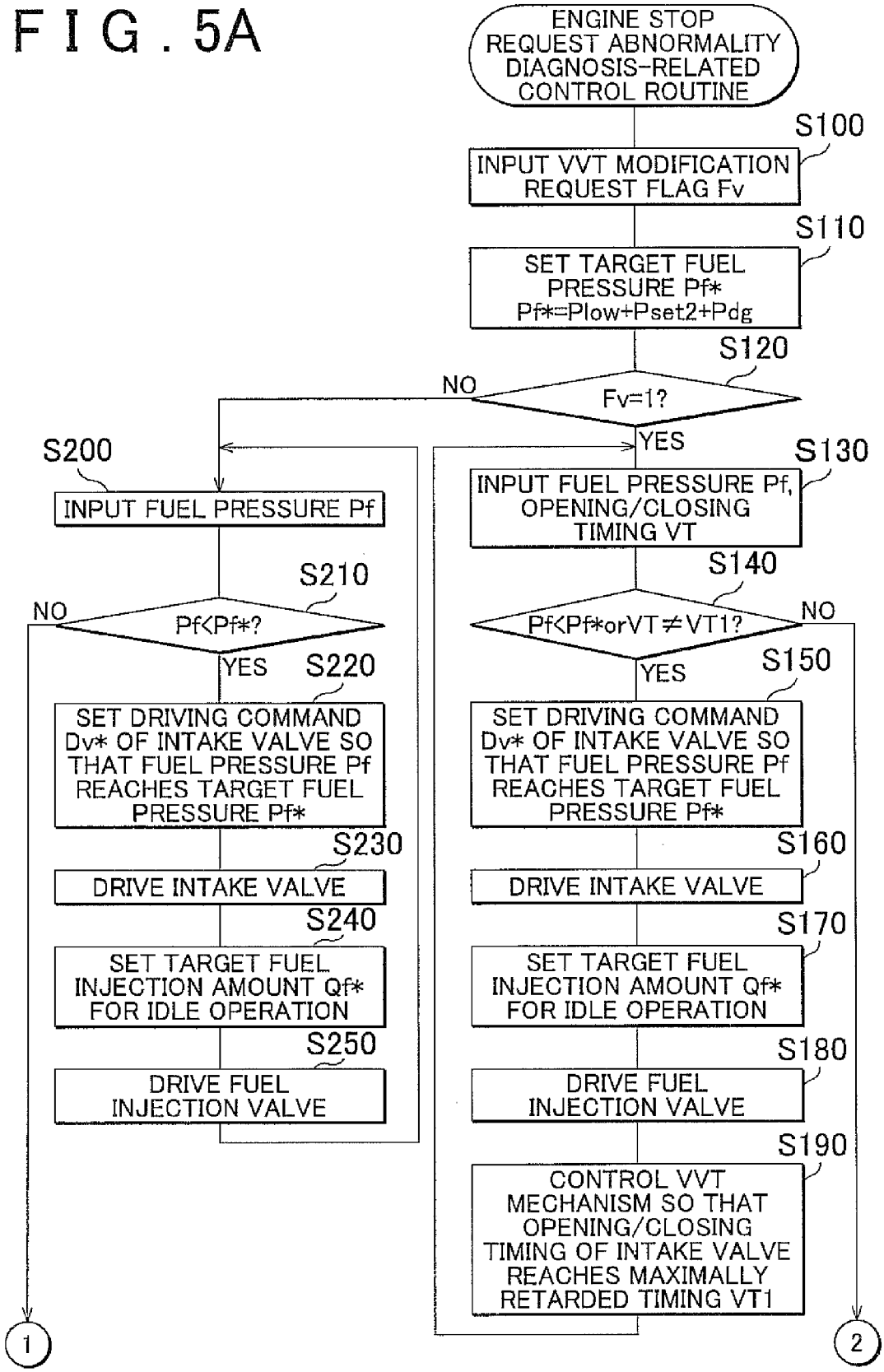
FIG. 5A is a flowchart showing an example of a control routine relating to an abnormality diagnosis executed at the time of an engine stop request by an engine electronic control unit (to be referred to hereafter as an engine ECU) according to an embodiment.
Figure 5B:
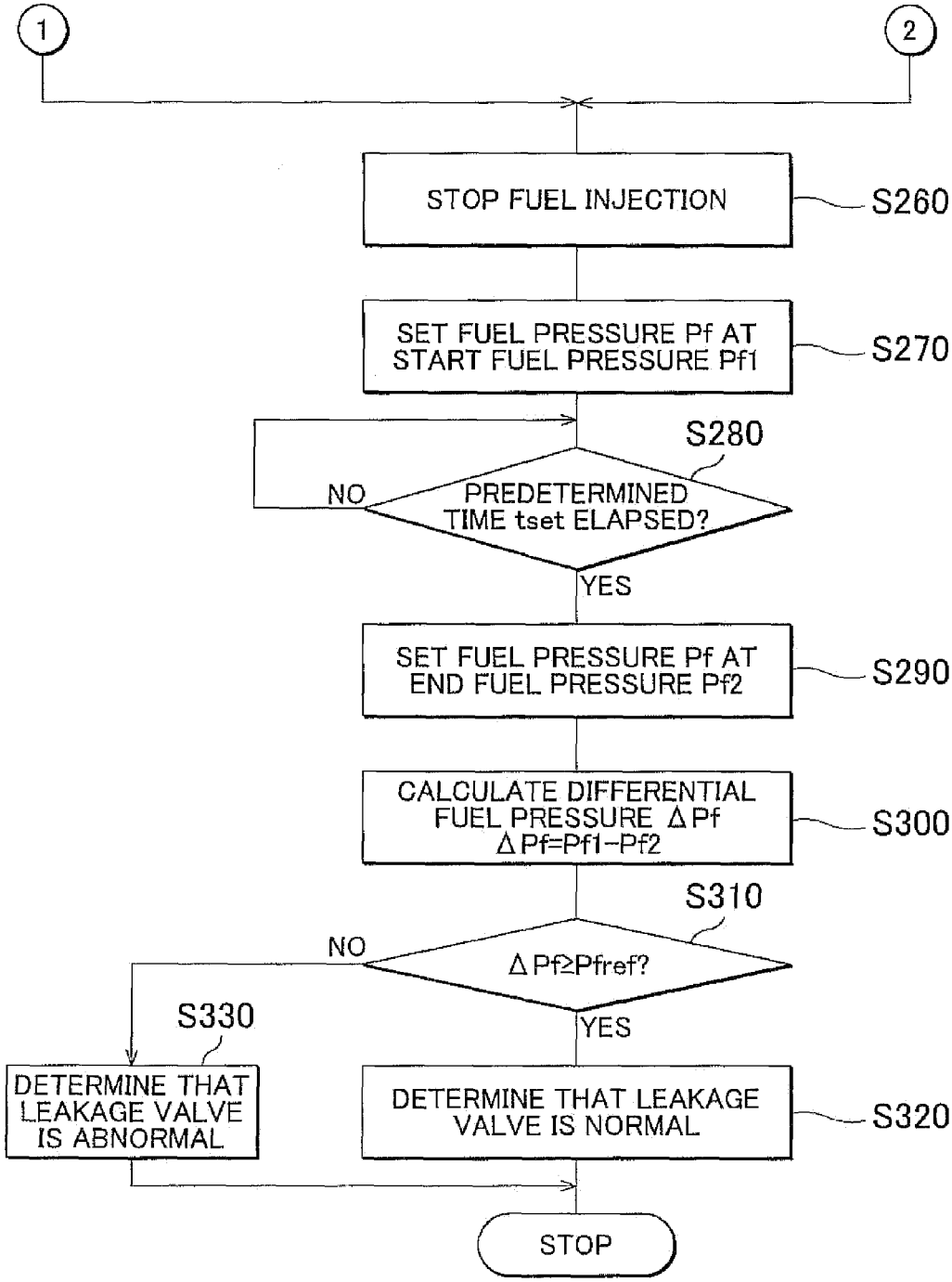
FIG. 5B is a flowchart showing an example of a control routine relating to an abnormality diagnosis executed at the time of an engine stop request by an engine electronic control unit (to be referred to hereafter as an engine ECU) according to an embodiment.

Next, an operation of the engine 20 according to this embodiment, and particularly an operation executed to diagnose an abnormality in the leakage check valve 98 immediately before the operation of the engine 20 is stopped, will be described. FIG. 5A and FIG. 5B are a flowchart showing an example of a control routine relating to an abnormality diagnosis, which is executed by the engine ECU 70 at the time of an engine stop request. This routine is executed when an accelerator is switched OFF, causing power to be output from the engine 20 to fall below a threshold or the like such that a request is issued to stop the operation of the engine 20, in a state where an abnormality diagnosis has not yet been executed on the leakage check valve 98 after switching the ignition of the vehicle ON (before switching the ignition OFF) (i.e., a state where an abnormality diagnosis execution condition is established).

When the engine stop request abnormality diagnosis-related control routine is executed, first, the CPU 72 of the engine ECU 70 inputs a VVT modification request flag Fv requesting modification of the opening/closing timing VT of the intake valve 28 by the variable valve timing mechanism 50 (Step S100), and executes processing for setting a target fuel pressure Pf* serving as a target value of the fuel pressure in the high pressure fuel pipe 94 at a total pressure of the predetermined low pressure Plow serving as the fuel pressure of the low pressure fuel pipe 84, the set pressure Pset2 of the leakage check valve 98, and a predetermined determination confirmation pressure Pdg (Step S110). Here, the VVT modification request flag Fv is set at a value 0 when a request to modify the opening/closing timing VT of the intake valve 28 to a maximally retarded timing VT1 has not been issued and set at a value 1 when this modification is requested. In this embodiment, the VVT modification request flag Fv is set at the value 1 when, for example, a load operation is being performed in the engine 20 immediately before an operation stop request is issued such that the opening/closing timing VT of the intake valve 28 is set on the advancement side of the maximally retarded timing VT1, or the like, and set at the value 0 when, for example, the engine 20 is performing an idle operation immediately before the operation stop request is issued such that the opening/closing timing VT of the intake valve 28 has already been modified to the maximally retarded timing VT1, or the like. The predetermined low pressure Plow and the set pressure Pset2 were described above, and the predetermined determination confirmation pressure Pdg is a pressure (1 MPa, 2 MPa, or the like, for example) determined in advance through experiment or the like at which it is possible to determine reliably that the leakage check valve 98 is operating normally.

Next, the input VVT modification request flag Fv is checked (Step S120), and when the VVT modification request flag Fv is at the value 1, it is determined that an idle operation is required in the engine 20, even though a request to stop the operation of the engine 20 has been issued. Accordingly, the fuel pressure Pf of the high pressure fuel pipe 94 from the fuel pressure sensor 94*a* and the opening/closing timing VT of the intake valve 28 are input (Step S130), and determinations are made as to whether or not the input fuel pressure Pf of the high pressure fuel pipe 94 is lower than the set target fuel pressure Pf* and whether or not the opening/closing timing VT corresponds to the maximally retarded timing VT1 (Step S140). It is assumed here that a value calculated on the basis of an angle (θca-θcr) of the cam angle Om of the intake camshaft 29 of the intake valve 28, obtained from the cam position sensor 44, relative to a crank angle θcr obtained from the crank position sensor 40 is input as the opening/closing timing VT.

When the fuel pressure Pf is lower than the target fuel pressure Pf*, the opening/closing timing VT does not correspond to the maximally retarded timing VT1, or both of these conditions are established, it is determined that an idle operation is to be performed in the engine 20. Accordingly, a driving command Dv* is issued in relation to the intake valve 104 of the high pressure fuel pump 100 to drive the intake valve 104 such that the fuel pressure Pf in the high pressure fuel pipe 94 matches the target fuel pressure Pf* (Steps S150, S160), the target fuel injection amount Qf* is set at a predetermined amount required for an idle operation in the engine 20, whereupon the port fuel injection valve 83 and the in-cylinder fuel injection valve 92 are driven (Steps S170, S180), and the variable valve timing mechanism 50 is controlled such that the opening/closing timing VT of the intake valve 28 reaches the maximally retarded timing VT1 (Step S190). The routine then returns to Step S130, where the fuel pressure Pf and the opening/closing timing VT are input, and then advances to Step 140, where the fuel pressure Pf and the opening/closing timing VT are determined. It is assumed here that the VVT modification request flag Fv is at the value 1 such that at the start of the routine, the opening/closing timing VT of the intake valve 28 is on the advanced side of the maximally retarded timing VT1. Hence, the processing series of Steps S130 to S190 is processing for modifying the opening/closing timing VT of the intake valve 28 to the maximally retarded timing VT1 in accordance with the idle operation of the engine 20, and setting the fuel pressure Pf in the high pressure fuel pipe 94 at a higher pressure than the idle operation fuel pressure Pfmin (=Plow+Pset2), regardless of the fuel pressure Pf in the high pressure fuel pipe 94 at the start of the routine, so that fuel injection through the in-cylinder fuel injection valve 92 is continued.

When it is determined in Step 140 that the fuel pressure Pf equals or exceeds the target fuel pressure PP and the opening/closing timing VT corresponds to the maximally retarded timing VT1, it is determined that the operation of the engine 20 is to be stopped and an abnormality diagnosis executed on the leakage check valve 98. Accordingly, fuel injection through the port fuel injection valve 83 and the in-cylinder fuel injection valve 92 is stopped (Step S260), the fuel pressure Pf of the high pressure fuel pipe 94 input most recently from the fuel pressure sensor 94*a* in Step S130 is set as a start fuel pressure Pf1 (Step S270), a predetermined time tset is allowed to elapse (Step S280), the fuel pressure Pf of the high pressure fuel pipe 94 input anew from the fuel pressure sensor 94*a* is set as an end fuel pressure Pf2 (Step S290), and a value obtained by subtracting the set end fuel pressure Pf2 from the set start fuel pressure Pf1 is calculated as a differential fuel pressure ΔPf (Step S300). In this embodiment, a time determined in advance through experiment or the like in which it is possible to determine reliably that the leakage check valve 98 is operating normally, similarly to the predetermined determination confirmation pressure Pdg, when fuel injection through the in-cylinder fuel injection valve 92 is stopped such that the fuel pressure Pf in the high pressure fuel pipe 94 decreases from the target fuel pressure PP (=Plow +Pset2 Pdg), and a time (several seconds or the like, for example) that is shorter than a time required for the fuel pressure Pf to decrease by the predetermined determination confirmation pressure Pdg when the leakage check valve 98 is operating normally, is used as the predetermined time tset.

After calculating the differential fuel pressure ΔPf in this manner, the differential fuel pressure ΔPf is compared to a threshold Pfref (Step S310), and when the differential fuel pressure ΔPf equals or exceeds the threshold Pfref, it is determined that the leakage check valve 98 is operating normally (Step S320). When the differential fuel pressure ΔPf is lower than the threshold Pfref, on the other hand, it is determined that an abnormality preventing the leakage check valve 98 from operating normally has occurred (Step S330), and the engine stop request abnormality diagnosis-related control routine is terminated. Note that when the low pressure fuel pump 86 is driven while the ignition of the vehicle is ON, the fuel pressure Pf in the high pressure fuel pipe 94 decreases toward a total pressure of the predetermined low pressure Plow and the set pressure Pset2 of the leakage check valve 98. With this control, when an idle operation is required in the engine 20 to set the opening/closing timing VT of the intake valve 28 at the maximally retarded timing VT1, even though a request to stop the operation of the engine 20 (in other words, a request to stop fuel injection through the in-cylinder fuel injection valve 92) is issued in a state where the execution condition for the abnormality diagnosis on the leakage check valve 98 is established, the high pressure control pump 100 is controlled such that the fuel pressure Pf in the high pressure fuel pipe 94 reaches the target fuel pressure Pf* and fuel injection through the in-cylinder fuel injection valve 92 is continued for the idle operation. Then, when the opening/closing timing VT has reached the maximally retarded timing VT1 and the fuel pressure Pf has reached the target fuel pressure Pf*, fuel injection through the in-cylinder fuel injection valve 92 is stopped and the abnormality diagnosis is executed on the leakage check valve 98. In so doing, the period of the idle operation in the engine 20 can be used to set the fuel pressure Pf in the high pressure fuel pipe 94 at the target fuel pressure Pf* for the abnormality diagnosis, and as a result, the abnormality diagnosis can be executed on the leakage check valve 98 more reliably.

When the VVT modification request flag Fv is at the value 0 in Step S120, the fuel pressure Pf of the high pressure fuel pipe 94 is input from the fuel pressure sensor 94*a* (Step S200), and a determination is made as to whether or not the input fuel pressure Pf of the high pressure fuel pipe 94 is lower than the set target fuel pressure Pf* (Step S210). When the fuel pressure Pf is lower than the target fuel pressure Pf*, the driving command Dv* is set in relation to the intake valve 104 of the high pressure fuel pump 100 and the intake valve 104 is driven such that the fuel pressure Pf in the high pressure fuel pipe 94 matches the target fuel pressure Pf* (Steps S220, S230), and the target fuel injection amount Qf* is set at an amount required for an idle operation in the engine 20, whereupon the port fuel injection valve 83 and the in-cylinder fuel injection valve 92 are driven (Steps S240, S250), similarly to the processing of Steps S150 to S180. The routine then returns to Step S200, where the fuel pressure Pf is input, and then advances to Step 210, where the fuel pressure Pf is determined. A case in which the VVT modification request flag Fv is at the value 0 and the fuel pressure Pf of the high pressure fuel pipe 94 is lower than the target fuel pressure Pf* at the start of the routine may occur when, for example, the fuel pressure Pf of the high pressure fuel pipe 94 is set at the idle operation fuel pressure Pfmin such that the engine 20 performs an idle operation immediately before an operation stop request is issued in relation to the engine 20, or the like.

When the fuel pressure Pf of the high pressure fuel pipe 94 is not lower than the target fuel pressure Pf* in Step S210, it is determined that an abnormality diagnosis is to be executed on the leakage check valve 98. Accordingly, fuel injection into the engine 20 is stopped, the start fuel pressure Pf1 is set, the end fuel pressure Pf2 is set following the elapse of the predetermined time tset, and a determination as to whether the leakage check valve 98 is normal or abnormal is made by comparing the differential fuel pressure ΔPf obtained from the start fuel pressure Pf1 and the end fuel pressure Pf2 with the threshold Pfref (Steps S260 to S330). The engine stop request abnormality diagnosis-related control routine is then terminated. A case in which the fuel pressure Pf is not lower than the target fuel pressure PP in Step S210 may occur when the VVT modification request flag Fv is at the value 0 and the fuel pressure Pf of the high pressure fuel pipe 94 has increased to or above the target fuel pressure Pf* from below the target fuel pressure Pf* at the start of the routine, or when the VVT modification request flag Fv is at the value 0 and the fuel pressure Pf of the high pressure fuel pipe 94 is no lower than the target fuel pressure Pf* at the start of the routine. With this control, when the fuel pressure Pf of the high pressure fuel pipe 94 is lower than the target fuel pressure Pf* in a case where a request to stop the operation of the engine 20 (in other words, a request to stop fuel injection through the in-cylinder fuel injection valve 92) is issued in a state where the execution condition for the abnormality diagnosis on the leakage check valve is established, the high pressure fuel pump 100 is controlled such that the fuel pressure Pf in the high pressure fuel pipe 94 reaches the target fuel pressure PP and fuel injection through the in-cylinder fuel injection valve 92 is continued. Then, when the fuel pressure Pf has reached the target fuel pressure Pf, fuel injection through the in-cylinder fuel injection valve 92 is stopped and the abnormality diagnosis is executed on the leakage check valve 98. As a result, the abnormality diagnosis can be executed on the leakage check valve 98 more reliably.

With the fuel supply apparatus 80 for the engine 20 according to the embodiment described above, the leakage check valve 98 attached in a position that allows fuel to flow out into the fuel tank 82 from the high pressure fuel pipe 94 is used, and therefore the fuel pressure Pf in the high pressure fuel pipe 94 can be reduced using a simpler structure than when a pressure reducing valve that is open/close-controlled through electrification, such as a solenoid valve, is used. Further, when the fuel pressure Pf of the high pressure fuel pipe 94 is lower than the target fuel pressure Pf* in a case where fuel injection through the in-cylinder fuel injection valve 92 is to be stopped in a state where the execution condition for the abnormality diagnosis on the leakage check valve 98 is established, the high pressure fuel pump 100 is controlled such that the fuel pressure Pf in the high pressure fuel pipe 94 reaches the target fuel pressure Pf* and the abnormality diagnosis is executed on the leakage check valve 98 after the fuel pressure Pf has reached the target fuel pressure Pf*, and therefore the abnormality diagnosis can be executed on the leakage check valve 98 more reliably. Furthermore, when an idle operation is required in the engine 20 to set the opening/closing timing VT of the intake valve 28 at the maximally retarded timing VT1, even though fuel injection through the in-cylinder fuel injection valve 92 is to be stopped in response to a request in a state where the execution condition for the abnormality diagnosis on the leakage check valve 98 is established, the high pressure control pump 100 is controlled such that the fuel pressure Pf in the high pressure fuel pipe 94 reaches the target fuel pressure Pf' and fuel injection through the in-cylinder fuel injection valve 92 is continued for the idle operation. Then, when the opening/closing timing VT has reached the maximally retarded timing VT1 and the fuel pressure Pf has reached the target fuel pressure Pf*, fuel injection through the in-cylinder fuel injection valve 92 is stopped and the abnormality diagnosis is executed on the leakage check valve 98. In so doing, the period of the idle operation in the engine 20 can be used to set the fuel pressure Pf in the high pressure fuel pipe 94 at the target fuel pressure Pf' for the abnormality diagnosis, and as a result, the abnormality diagnosis can be executed on the leakage check valve 98 more reliably. Moreover, the target fuel pressure Pf* of the high pressure fuel pipe 94, which is regulated by the high pressure fuel pump 100 before the abnormality diagnosis is executed on the leakage check valve 98, is set at the total pressure of the predetermined low pressure Plow, the set pressure Pset2 of the leakage check valve 98, and the predetermined determination confirmation pressure Pdg, and therefore a misdiagnosis can be suppressed during the abnormality diagnosis on the leakage check valve 98.

In the fuel supply apparatus 80 for the engine 20 according to this embodiment, when the VVT modification request flag Fv is at the value 1 such that an idle operation is required in the engine 20, the high pressure control pump 100 is controlled such that the fuel pressure Pf in the high pressure fuel pipe 94 reaches the target fuel pressure Pf* and fuel injection through the in-cylinder fuel injection valve 92 is continued for the purpose of the idle operation, even though the execution condition for the abnormality diagnosis on the leakage check valve 98 is established and a request has been issued to stop the operation of the engine 20, and the abnormality diagnosis is executed on the leakage check valve 98 thereafter. However, it may be determined that an idle operation is required in the engine 20, even though a request to stop the operation of the engine 20 has been issued, on condition that a flag which is set at a value 0 when the cooling water temperature Tw of the engine 20 equals or exceeds a threshold and set at a value I when the cooling water temperature Tw is lower than the threshold is Set at the value 1 or the like, rather than on condition that the VVT modification request flag Fv is set at the value 1.

In the fuel supply apparatus 80 for the engine 20 according to this embodiment, when the VVT modification request flag Fv is at the value 1 in a case where a request is issued to stop the operation of the engine 20 in a state where the execution condition for the abnormality diagnosis on the leakage check valve 98 is established, the abnormality diagnosis is executed on the leakage check valve 98 after continuing fuel injection into the engine 20 until the fuel pressure Pf in the high pressure fuel pipe 94 reaches the target fuel pressure Pf* and the opening/closing timing VT of the intake valve 28 reaches the maximally retarded timing VT1. Further, when the VVT modification request flag Fv is at the value 0 in this state and the fuel pressure Pf is lower than the target fuel pressure Pf*, the abnormality diagnosis is executed on the leakage check valve 98 after continuing fuel injection into the engine 20 until the fuel pressure Pf reaches the target fuel pressure Pf*. Instead, however, a determination may be made as to whether or not the fuel pressure Pf is lower than the target fuel pressure Pf*, regardless of the value of the VVT modification request flag Fv, and when the fuel pressure Pf is lower than the target fuel pressure Pt*, the abnormality diagnosis may be executed on the leakage check valve 98 after continuing fuel injection into the engine 20 until the fuel pressure Pf reaches the target fuel pressure Pf*.

In the fuel supply apparatus 80 for the engine 20 according to this embodiment, a condition whereby an abnormality diagnosis has not been executed on the leakage check valve 98 since switching the ignition of the vehicle ON (before switching the ignition OFF) is used as the execution condition for the abnormality diagnosis on the leakage check valve 98. In addition, a condition whereby an abnormality was determined to have occurred in the leakage check valve 98 in a (preceding) abnormality diagnosis on the leakage check valve 98 may be used.

In the fuel supply apparatus 80 for the engine 20 according to this embodiment, when the VVT modification request flag Fv is at the value 0 in a case where a request is issued to stop the operation of the engine 20 in a state where the execution condition for the abnormality diagnosis on the leakage check valve 98 is established, the abnormality diagnosis is executed on the leakage check valve 98 after continuing fuel injection into the engine 20 (fuel injection through the port fuel injection valve 83 and the in-cylinder fuel injection valve 92) in accordance with the determination result obtained in relation to the fuel pressure Pf in the high pressure fuel pipe 94. Alternatively, when the execution condition for the abnormality diagnosis on the leakage check valve 98 is established, requests may be issued to switch from the combined injection driving mode to the port injection driving mode and to stop fuel injection through the in-cylinder fuel injection valve 92. In this case, fuel injection through the port fuel injection valve 83 is continued, and fuel injection through the in-cylinder fuel injection valve 92 is continued and then stopped in accordance with the determination result obtained in relation to the fuel pressure Pf in the high pressure fuel pipe 94. The abnormality diagnosis is then executed on the leakage check valve 98.

In the fuel supply apparatus 80 for the engine 20 according to this embodiment, the target fuel pressure Pf* of the high pressure fuel pipe 94, which is regulated by the high pressure fuel pump 100 before the abnormality diagnosis is executed on the leakage check valve 98, is set at the total pressure of the predetermined low pressure Plow, the set pressure Pset2 of the leakage check valve 98, and the predetermined determination confirmation pressure Pdg. Instead, however, the target fuel pressure Pf* of the high pressure fuel pipe 94 may be set at a slightly higher pressure than the sum of the predetermined low pressure Plow and the set pressure Pset2. Likewise in this case, a reduction in the fuel pressure Pf of the high pressure fuel pipe 94 can be checked as the abnormality diagnosis performed on the leakage check valve 98, and therefore an opportunity to execute the abnormality diagnosis can be secured.

In the fuel supply apparatus 80 for the engine 20 according to this embodiment, the target fuel pressure Pf* the high pressure fuel pipe 94 is set at the total pressure of the predetermined low pressure Plow, the set pressure Pset2 of the leakage check valve 98, and the predetermined determination confirmation pressure Pdg, and the high pressure fuel pump 100 is controlled such that the fuel pressure Pf reaches the target fuel pressure Pf*. Instead, however, a target fuel pressure may be set in accordance with target operating conditions for performing an idle operation or the like in the engine 20, and a lower limit fuel pressure of the high pressure fuel pipe 94 may be set at the total pressure of the predetermined low pressure Plow, the set pressure Pset2 of the leakage check valve 98, and the predetermined determination confirmation pressure Pdg. In this case, the high pressure fuel pump 100 is controlled such that the fuel pressure Pf reaches the higher of the target fuel pressure and the lower limit fuel pressure.

Figure 6A:
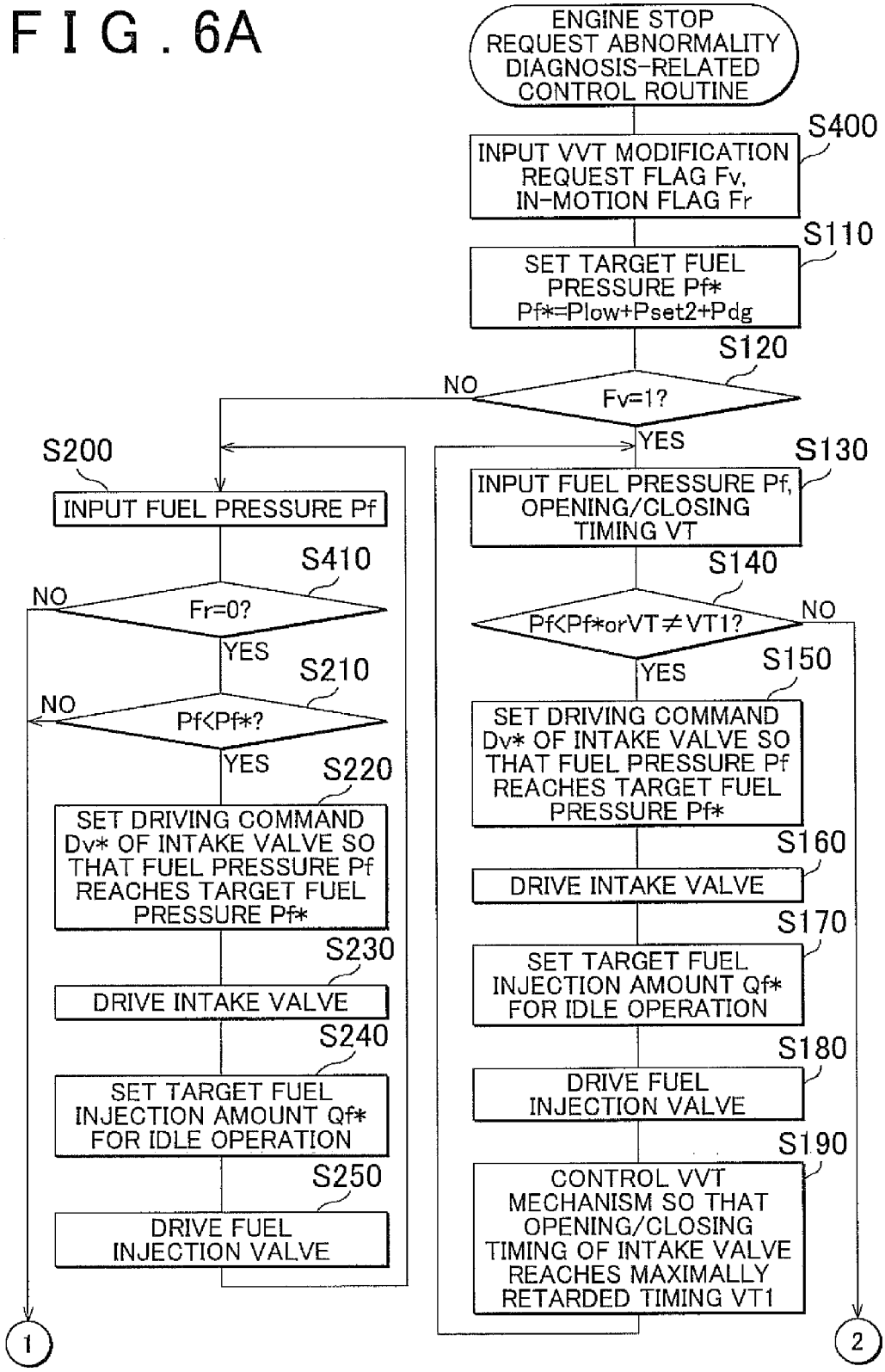
FIG. 6A is a flowchart showing an example of a control routine relating to an abnormality diagnosis executed at the time of an engine stop request by the engine ECU according to a modified example.
Figure 6B:
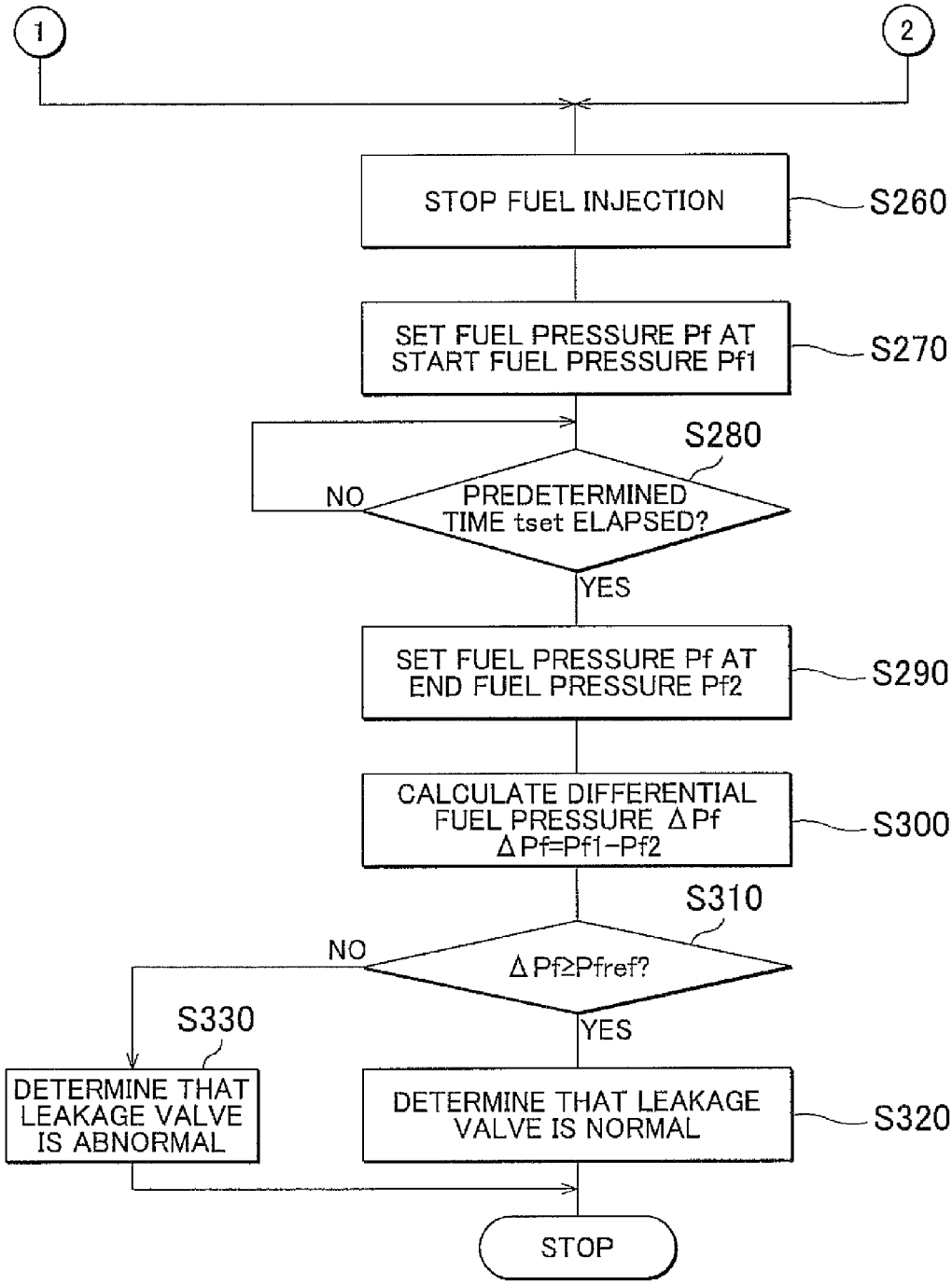
FIG. 6B is a flowchart showing an example of a control routine relating to an abnormality diagnosis executed at the time of an engine stop request by the engine ECU according to a modified example.

In the fuel supply apparatus 80 for the engine 20 according to this embodiment, when the VVT modification request flag Fv is at the value 0 and the fuel pressure Pf is lower than the target fuel pressure Pf* in a case where a request is issued to stop the operation of the engine 20 in a state where the execution condition for the abnormality diagnosis on the leakage check valve 98 is established, the abnormality diagnosis is executed on the leakage check valve 98 after driving the high pressure fuel pump 100 until the fuel pressure Pf reaches the target fuel pressure Pf* regardless of whether the vehicle is in motion or stationary. When the vehicle is not in motion, however, the abnormality diagnosis may be executed on the leakage check valve 98 without driving the high pressure fuel pump 100. In this case, an engine stop request abnormality diagnosis-related control routine shown in FIG. 6A and FIG. 6B may be executed instead of the engine stop request abnormality diagnosis-related control routine shown in FIG. 5A and FIG. 5B. The routine of FIG. 6A and FIG. 6B is identical to the routine of FIG. 5A and FIG. 5B except that processing of Step S400 is executed in place of the processing of Step S100 and processing of Step S410 is added. Accordingly, identical step numbers have been allocated to identical processes, and detailed description thereof has been omitted. In the engine stop request abnormality diagnosis-related control routine shown in FIG. 6A and FIG. 6B, first, the CPU 72 of the engine ECU 70 inputs an in-motion flag Fr, which is set at a value 1 after determining on the basis of a vehicle speed V from a vehicle speed sensor, not shown in the drawings, that the vehicle is not in motion (that the vehicle is stationary) and set at a value 0 after determining that the vehicle is in motion, from the vehicle ECU, not shown in the drawings, via communication, and inputs the VVT modification request flag Fv (Step S400). After setting the target fuel pressure Pf* and inputting the fuel pressure Pf from the fuel pressure sensor 94*a* when the VVT modification request flag Fv is at the value 0 (Steps S110, S120), the in-motion flag Fr is checked (Step S410), and when the in-motion flag Fr is at the value 0, it is determined that due to background noise generated by the motion of the vehicle, noise generated by driving the high pressure pump 100 will not disturb a driver or a passenger. The fuel pressure Pf is then compared to the target fuel pressure Pf*, and when the fuel pressure Pf is lower than the target fuel pressure Pf*, the high pressure fuel pump 100 is driven and fuel injection into the engine 20 is continued until the fuel pressure Pf reaches the target fuel pressure Pf*. The abnormality diagnosis is then executed on the leakage check valve 98 (Steps S220 to S330). When the fuel pressure Pf equals or exceeds the target fuel pressure PP, on the other hand, fuel injection into the engine 20 is stopped immediately without driving the high pressure fuel pump 100 (by opening the intake valve 104). The abnormality diagnosis is then executed on the leakage check valve 98 (Steps S260 to S330), whereupon the routine is terminated. When the in-motion flag Fr is at the value 1 in Step 410, meanwhile, it is determined that noise generated by driving the high pressure fuel pump 100 may disturb the driver or passenger, and therefore fuel injection into the engine 20 is stopped immediately without driving the high pressure fuel pump 100 (by opening the intake valve 104). The abnormality diagnosis is then executed on the leakage check valve 98 (Steps S260 to S330), whereupon the routine is terminated. With this control, driving of the high pressure fuel pump 100 can be suppressed in a state where background noise is not being generated by the motion of the vehicle, and therefore the driver and passenger can be prevented from being disturbed by noise generated when the high pressure fuel pump 100 is driven. Note that when the abnormality diagnosis is executed on the leakage check valve 98 after stopping fuel injection into the engine 20 immediately without driving the high pressure fuel pump 100 while the vehicle is in motion, an abnormality is more likely to be determined in the leakage check valve 98. However, the condition whereby an abnormality was determined to have occurred in the leakage check valve 98 in the (preceding) abnormality diagnosis on the leakage check valve 98 may be used in addition to the condition whereby an abnormality diagnosis has not been executed on the leakage check valve 98 since switching the ignition of the vehicle ON (before switching the ignition OFF) as the execution condition for the abnormality diagnosis on the leakage check valve 98.

Figure 7:
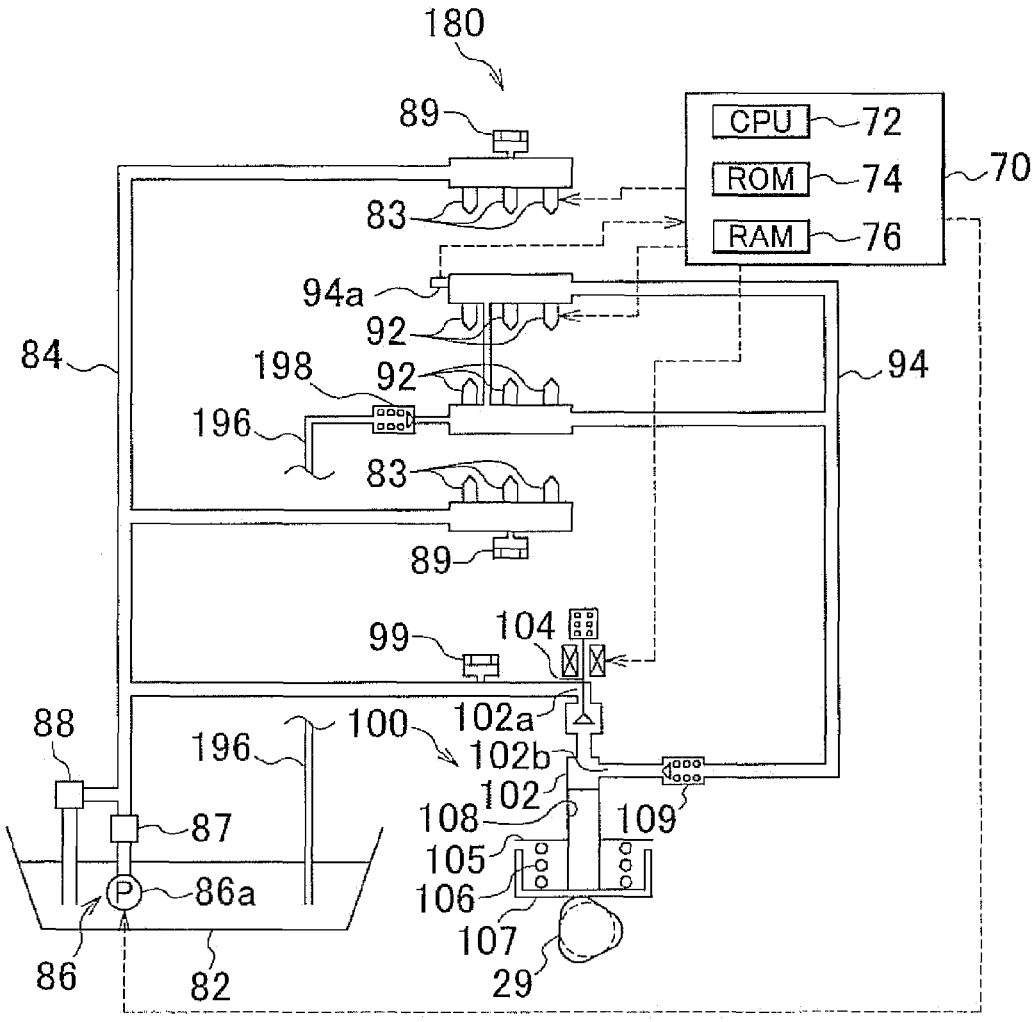
FIG. 7 is a schematic diagram showing the structure of a fuel supply apparatus according to a modified example.

In the fuel supply apparatus 80 for the engine 20 according to this embodiment, the leakage check valve 98 is attached to the bypass pipe 96 that is connected to the high pressure fuel pipe 94 and the discharge port 102*b* for discharging fuel from the compression chamber 102 of the high pressure fuel pump 100 so as to bypass the pump check valve 109, i.e. in a position that allows the fuel to flow from the high pressure fuel pipe 94 into the fuel tank 82 via the high pressure fuel pump 100. In a fuel supply apparatus 180 according to a modified example shown in FIG. 7, however, a leakage check valve 198 may be attached to a pipe 196 that allows the fuel to flow directly into the fuel tank 82 from the high pressure fuel pipe 94 without passing through the high pressure fuel pump 100. For example, the leakage check valve may be attached to a pipe that connects the low pressure fuel pipe 84 and the high pressure fuel pipe 94 so that the fuel can flow from the high pressure fuel pipe 94 into the fuel tank 82 via the low pressure fuel pipe 84. When the fuel supply apparatus 180 according to the modified example shown in FIG. 7 is employed, the target fuel pressure Pf* on the high pressure fuel pipe 94 side of the leakage check valve 198 may be set at a higher pressure than a set pressure of the leakage check valve 198 before executing the abnormality diagnosis on the leakage check valve 198.

In the fuel supply apparatus 80 for the engine 20 according to this embodiment, when the VVT modification request flag Fv is at the value 0 and the fuel pressure Pf in the high pressure fuel pipe 94 is lower than the target fuel pressure Pf* in a case where a request is issued to stop the operation of the engine 20 in a state where the execution condition for the abnormality diagnosis on the leakage check valve 98 is established, the abnormality diagnosis is executed on the leakage check valve 98 after controlling the high pressure fuel pump 100 such that the fuel pressure Pf reaches the target fuel pressure Pf* while continuing to inject fuel into the engine 20 and then stopping fuel injection into the engine 20. When the fuel pressure Pf of the high pressure fuel pipe 94 is lower than the target fuel pressure Pf* in this case, however, fuel injection into the engine 20 may be stopped immediately, whereupon the abnormality diagnosis is executed on the leakage check valve 98 after controlling the high pressure fuel pump 100 such that the fuel pressure Pf reaches the target fuel pressure Pf*. In this case, when the high pressure fuel pump 100 is controlled to set the fuel pressure Pf at the target fuel pressure Pf* in a state where fuel injection into the engine 20 is stopped, motoring may be executed on the engine 20 by a motor, not shown in the drawings, such that the high pressure fuel pump 100 is driven by the rotation of the engine 20. Further, in a case where the high pressure fuel pump is driven by the motor, not shown in the drawings, instead of or in addition to the intake camshaft 29, the high pressure fuel pump may be driven directly by the motor, not shown in the drawings, to control the high pressure fuel pump such that the fuel pressure Pf reaches the target fuel pressure Pf* in a state where fuel injection into the engine 20 is stopped.

The fuel supply apparatus 80 for the engine 20 according to this embodiment is provided with the port fuel injection valve 83 and the in-cylinder fuel injection valve 92. However, the port fuel injection valve 83 may be omitted such that the fuel supply apparatus 80 includes only the in-cylinder fuel injection valve 92.

Correspondence relationships between principal elements of the embodiment and principal elements of the inventions set forth in the Summary of the Invention will now be described. In the embodiment, the in-cylinder fuel injection valve 92 may be considered as an example of a "fuel injection valve", the high pressure fuel pipe 94 may be considered as an example of a "delivery passage", the fuel tank 82 may be considered as an example of a "fuel tank", the leakage check valve 98 may be considered as an example of a "check valve", the fuel pressure sensor 94*a* may be considered as an example of a "fuel pressure sensor", and the engine ECU 70 that executes the engine stop request abnormality diagnosis-related control routine shown in FIG. 5A and FIG. 5B, in which, when the fuel pressure Pf in the high pressure fuel pipe 94 is lower than the target fuel pressure Pf* in a case where a request is issued to stop fuel injection through the in-cylinder fuel injection valve 92 in a state where the execution condition for the abnormality diagnosis on the leakage check valve 98 is established, the high pressure fuel pump 100 is controlled such that the fuel pressure Pf in the high pressure fuel pipe 94 reaches the target fuel pressure Pf* while continuing to inject fuel through the in-cylinder fuel injection valve 92, and when the fuel pressure Pf reaches the target fuel pressure Pf*, fuel injection through the in-cylinder fuel injection valve 92 is stopped, whereupon the abnormality diagnosis is executed on the leakage check valve 98, may be considered as an example of a "control unit".

Here, the "fuel injection valve" is not limited to the in-cylinder fuel injection valve 92 that injects fuel directly into the cylinder, and any type of fuel injection valve that performs fuel injection into an internal combustion engine may be used. The "delivery passage" is not limited to the high pressure fuel pipe 94 that delivers fuel regulated to the desired high pressure to the in-cylinder fuel injection valve 92, and any device that delivers fuel to a fuel injection valve may be employed. The "fuel tank" is not limited to the fuel tank 82, and any device that stores fuel may be used. The "check valve" is not limited to the leakage check valve 98 attached to the bypass pipe 96 that bypasses the pump check valve 109, and any valve that is disposed in a position that allows the fuel to flow out of the delivery passage into the fuel tank, that opens when the fuel pressure on the delivery passage side from the check valve is higher than the fuel pressure on the fuel tank side from the check valve by at least the set pressure set at the fuel pressure permitted to act on the fuel injection valve when fuel injection by the fuel injection valve is stopped, and that while open allows the fuel to flow in an amount that does not obstruct pressure regulation of the fuel pumped into the delivery passage by the fuel pump to the desired pressure, such as a valve attached in a position that allows the fuel to flow directly into the fuel tank 82 from the high pressure fuel pipe 94, may be used. The "fuel pressure sensor" is not limited to the fuel pressure sensor 94*a*, and any device that is attached to the delivery passage to detect the pressure of the fuel in the delivery passage may be used. The "control unit" is not limited to a single ECU, and a plurality of ECUs may be used in combination. Further, the "control unit" is not limited to a device which, when the fuel pressure Pf in the high pressure fuel pipe 94 is lower than the target fuel pressure Pf* in a case where a request is issued to stop fuel injection through the in-cylinder fuel injection valve 92 in a state where the execution condition for the abnormality diagnosis on the leakage check valve 98 is established, controls the high pressure fuel pump 100 such that the fuel pressure Pf in the high pressure fuel pipe 94 reaches the target fuel pressure Pf* while continuing to inject fuel through the in-cylinder fuel injection valve 92, and when the fuel pressure Pf reaches the target fuel pressure Pf*, stops fuel injection through the in-cylinder fuel injection valve 92 and then executes the abnormality diagnosis on the leakage check valve 98, and any device which, when the fuel pressure detected by the fuel pressure sensor is lower than a diagnosis lower limit pressure set at a higher pressure than the set pressure in a case where the fuel injection by the fuel injection valve is to be stopped in a state where an execution condition for an abnormality diagnosis on the check valve, in which the presence of an abnormality in the check valve is diagnosed by confirming a reduction in the fuel pressure detected by the fuel pressure sensor, is established, controls the fuel pump so that the fuel pressure in the delivery passage rises to or above the diagnosis lower limit pressure, and executes the abnormality diagnosis on the check valve after the fuel pressure detected by the fuel pressure sensor has reached or exceeded the diagnosis lower limit pressure, may be used.

Note that the correspondence relationships between the principal elements of the embodiment and the principal elements of the inventions set forth in the Summary of the Invention are examples for illustrating a specific embodiment of the inventions set forth in the Summary of the Invention, and do not limit the elements of the inventions set forth in the Summary of the Invention. In other words, the inventions set forth in the Summary of the Invention are to be interpreted on the basis of the description in Summary of the Invention, and the embodiment is merely one specific example of the inventions set forth in the Summary of the Invention.

An embodiment of the invention was described above, but the invention is not limited in any way to this embodiment, and may be implemented in various embodiments within a scope that does not depart from the invention.

The invention may be used, for example, in the manufacturing industry for fuel supply apparatuses used in internal combustion engines.

What is claimed is:

1. A fuel supply apparatus for an internal combustion engine, having a fuel injection valve that performs fuel injection into the internal combustion engine, a delivery passage that delivers fuel to the fuel injection valve, a fuel tank that stores the fuel, and a fuel pump that regulates the fuel from the fuel tank to a desired pressure and pumps the fuel to the delivery passage, comprising:

a check valve that is disposed in a position that allows the fuel to flow out of the delivery passage into the fuel tank, that opens when a fuel pressure on the delivery passage side with respect to the check valve is higher than a fuel pressure on the fuel tank side with respect to the check valve by at least a set pressure set at a fuel pressure permitted to act on the fuel injection valve when the fuel injection by the fuel injection valve is stopped, and that while open allows the fuel to flow in an amount that enables the fuel pumped into the delivery passage by the fuel pump to be regulated to the desired pressure;

a fuel pressure sensor that is attached to the delivery passage to detect the fuel pressure in the delivery passage; and a control unit that, when the fuel pressure detected by the fuel pressure sensor is lower than a diagnosis lower limit pressure being higher than the set pressure in a case where the fuel injection by the fuel injection valve is to be stopped in a state where an execution condition for an abnormality diagnosis on the check valve, in which the presence of an abnormality in the check valve is diagnosed by confirming a reduction in the fuel pressure detected by the fuel pressure sensor, is established, controls the fuel pump so that the fuel pressure in the delivery passage rises to or above the diagnosis lower limit pressure, and executes the abnormality diagnosis on the check valve after the fuel pressure detected by the fuel pressure sensor has reached or exceeded the diagnosis lower limit pressure.

2. The fuel supply apparatus according to claim 1, wherein, when an idle operation is required in the internal combustion engine, even though the fuel injection by the fuel injection valve is to be stopped in response to a request in a state where the execution condition for the abnormality diagnosis on the check valve is established, the control unit controls the fuel pump and the fuel injection valve such that the fuel pressure in the delivery passage reaches or exceeds the diagnosis lower limit pressure and the fuel injection by the fuel injection valve is continued in order to perform the idle operation in the internal combustion engine, and when a predetermined termination condition for terminating the idle operation in the internal combustion engine is established and the fuel pressure detected by the fuel pressure sensor has reached or exceeded the diagnosis lower limit pressure, the control unit controls the fuel injection valve such that the fuel injection by the fuel injection valve is stopped, and executes the abnormality diagnosis on the check valve.

3. The fuel supply apparatus according to claim 2, wherein the predetermined termination condition is established when an opening/closing timing of an intake valve in the internal combustion engine reaches a predetermined stop timing.

4. The fuel supply apparatus according to claim 1, wherein the fuel pump includes a compression chamber connected to the delivery passage and a supply passage to which fuel regulated to a predetermined low pressure is supplied from the fuel tank, an intake valve disposed in a fuel intake port between the supply passage and the compression chamber, and a pump check valve that is interposed between a discharge port for discharging the fuel from the compression chamber and the delivery passage, and opens when a fuel pressure on the discharge port side with respect to the check valve is higher than a fuel pressure on the delivery passage side with respect to the check valve by at least a second set pressure set at a lower pressure than the predetermined low pressure, when driven by a rotation of the internal combustion engine, the fuel pump pumps the fuel regulated to the desired pressure into the delivery passage by adjusting an opening/closing timing of the intake valve, and when not driven by the rotation of the internal combustion engine, the intake valve is opened to communicate the supply passage with the discharge port, the check valve is disposed in a bypass passage that is connected to the delivery passage and to the discharge port or the fuel tank side with respect to the discharge port so as to bypass the pump check valve, the bypass passage serving as the position, and the control unit uses a higher pressure than a total pressure of the predetermined low pressure and the set pressure as the diagnosis lower limit pressure to control the opening/closing timing of the intake valve of the fuel pump when controlling the fuel pressure in the delivery passage to or above the diagnosis lower limit pressure.

5. The fuel supply apparatus according to claim 4, wherein the diagnosis lower limit pressure is set at a total pressure of the predetermined low pressure, the set pressure, and a predetermined determination confirmation pressure that is set at a pressure required to determine that the check valve is operating normally.

6. The fuel supply apparatus according to claim 1, wherein, the fuel supply apparatus is installed in a vehicle, and if the vehicle is not in motion even when the fuel pressure detected by the fuel pressure sensor is lower than the diagnosis lower limit pressure in a case where the fuel injection by the fuel injection valve is to be stopped in the state where the execution condition for the abnormality diagnosis on the check valve is established, the control unit executes the abnormality diagnosis on the check valve without driving the fuel pump.

7. A control method of a fuel supply apparatus for an internal combustion engine, the fuel supply apparatus having a fuel injection valve that performs fuel injection into the internal combustion engine, a delivery passage that delivers fuel to the fuel injection valve, a fuel tank that stores the fuel, a fuel pump that regulates the fuel from the fuel tank to a desired pressure and pumps the fuel to the delivery passage, a check valve that is disposed in a position that allows the fuel to flow out of the delivery passage into the fuel tank, that opens when a fuel pressure on the delivery passage side with respect to the check valve is higher than a fuel pressure on the fuel tank side with respect to the check valve by at least a set pressure set at a fuel pressure permitted to act on the fuel injection valve when the fuel injection by the fuel injection valve is stopped, and that while open allows the fuel to flow in an amount that enables the fuel pumped into the delivery passage by the fuel pump to be regulated to the desired pressure, and a fuel pressure sensor that is attached to the delivery passage to detect the fuel pressure in the delivery passage, comprising:

controlling the fuel pump so that the fuel pressure in the delivery passage rises to or above a diagnosis lower limit pressure being higher than the set pressure when the fuel pressure detected by the fuel pressure sensor is lower than the diagnosis lower limit pressure in a case where the fuel injection by the fuel injection valve is to be stopped in a state where an execution condition for an abnormality diagnosis on the check valve, in which the presence of an abnormality in the check valve is diagnosed by confirming a reduction in the fuel pressure detected by the fuel pressure sensor, is established, and executing the abnormality diagnosis on the check valve after the fuel pressure detected by the fuel pressure sensor has reached or exceeded the diagnosis lower limit pressure.

* * * * *